US008486509B2

(12) United States Patent
Huang

(10) Patent No.: US 8,486,509 B2
(45) Date of Patent: Jul. 16, 2013

(54) PATTERNS HAVING VARIABLE COLORS

(76) Inventor: Min-San Huang, Taipei County (TW)

( * ) Notice: Subject to any disclaimer, the term of this patent is extended or adjusted under 35 U.S.C. 154(b) by 504 days.

(21) Appl. No.: 11/506,813

(22) Filed: Aug. 21, 2006

(65) Prior Publication Data

US 2007/0202299 A1 Aug. 30, 2007

(30) Foreign Application Priority Data

Feb. 24, 2006 (TW) ..... 95203224 U

(51) Int. Cl.
*A41D 27/08* (2006.01)
*D06Q 1/10* (2006.01)
*E01F 9/04* (2006.01)

(52) U.S. Cl.
USPC ..... 428/141; 428/98; 428/119; 428/156; 428/161; 428/187

(58) Field of Classification Search
USPC ..... 428/141, 161, 156, 98, 119, 187
See application file for complete search history.

(56) References Cited

U.S. PATENT DOCUMENTS

| | | | | | |
|---|---|---|---|---|---|
| 1,329,900 | A | * | 2/1920 | Hanington | 428/206 |
| 2,416,521 | A | * | 2/1947 | Freiberg | 428/172 |
| 3,481,663 | A | * | 12/1969 | Greenstein | 359/577 |
| 4,584,785 | A | * | 4/1986 | von Danwitz | 40/316 |
| 5,759,928 | A | * | 6/1998 | Harper | 442/337 |

* cited by examiner

*Primary Examiner* — Brent O'Hern
(74) *Attorney, Agent, or Firm* — Schmeiser, Olsen & Watts LLP

(57) ABSTRACT

A pattern having variable colors can be attached on a soft material of wearing apparels or household cloths. The pattern is constituted of decorative blocks provided on the surface of the cloth or the soft material and a plurality of color-shielding pieces embedded on the surface of the decorative blocks. At least two opposite outer sides of the color-shielding piece are respectively provided with a colored block, so that the decorative blocks represent a visual effect of variable colors when viewed from different angles since the color-shielding pieces shield the colored blocks.

3 Claims, 4 Drawing Sheets

PATTERNS HAVING VARIABLE COLORS

BACKGROUND OF THE INVENTION

1. Field of the Invention

The present invention relates to a pattern having variable colors. Especially, the present invention can be applied to soft materials such as wearing apparels or household cloths in which the pattern is added to increase the decorative effect. Further, with the change of the viewing angle, the viewer can get distinct visual feelings of variable colors.

2. Description of Prior Art

Many apparels or household cloths are additionally provided with various decorations thereon. For example, the addition of the patterns is one of the most common ways. The patterns are presented on the surface of the cloth by embroidering or printing, thereby to emphasize its unique style and satisfy the relish and demand of customers.

In order to outstand the visual effect of the pattern, the colors, materials and processing manners of the patterns are important factors having an influence on the representation of the patterns. Therefore, many manufacturers aim to develop novel and improved manners for representing the patterns.

Since the pattern on the cloth still belongs to a static design, when the pattern and its colors are viewed from different angles, only the shape of the pattern may be changed due to the individual viewing angle. However, the pattern itself still represents a stiff and toneless visual effect. In view of this, although the manufacturers in this art have continuously tried to find a feasible solution, there is no ideal solution so far.

SUMMARY OF THE INVENTION

In view of the toneless visual effect represented by the patterns on the wearing apparels and household cloths, the object of the present invention is to provide a pattern capable of providing a vivid and variable visual effect.

According to the above objects, the present invention provides a pattern utilizing the interference of color. The pattern is constituted of decorative blocks provided on a cloth or soft material and a plurality of color-shielding pieces embedded on the surface of the decorative blocks. At least two opposite outer sides of the color-shielding piece are provided with a colored block, respectively. With the above arrangement, when the decorative blocks are viewed from different angles, they seem to have variable colors since the color-shielding pieces shield the colored blocks.

The following embodiments describe the characteristics and advantages of the present invention in detail, so that those skilled in this art can implement the present invention by utilizing the technical content thereof and easily understand the object and advantages of the present invention in view of the disclosure, claims and drawings thereof.

DETAILED DESCRIPTION OF THE INVENTION

In order to further understand the objects, structure and functions of the present invention, the preferred embodiments thereof will be described in detailed as follows.

Figure 1:
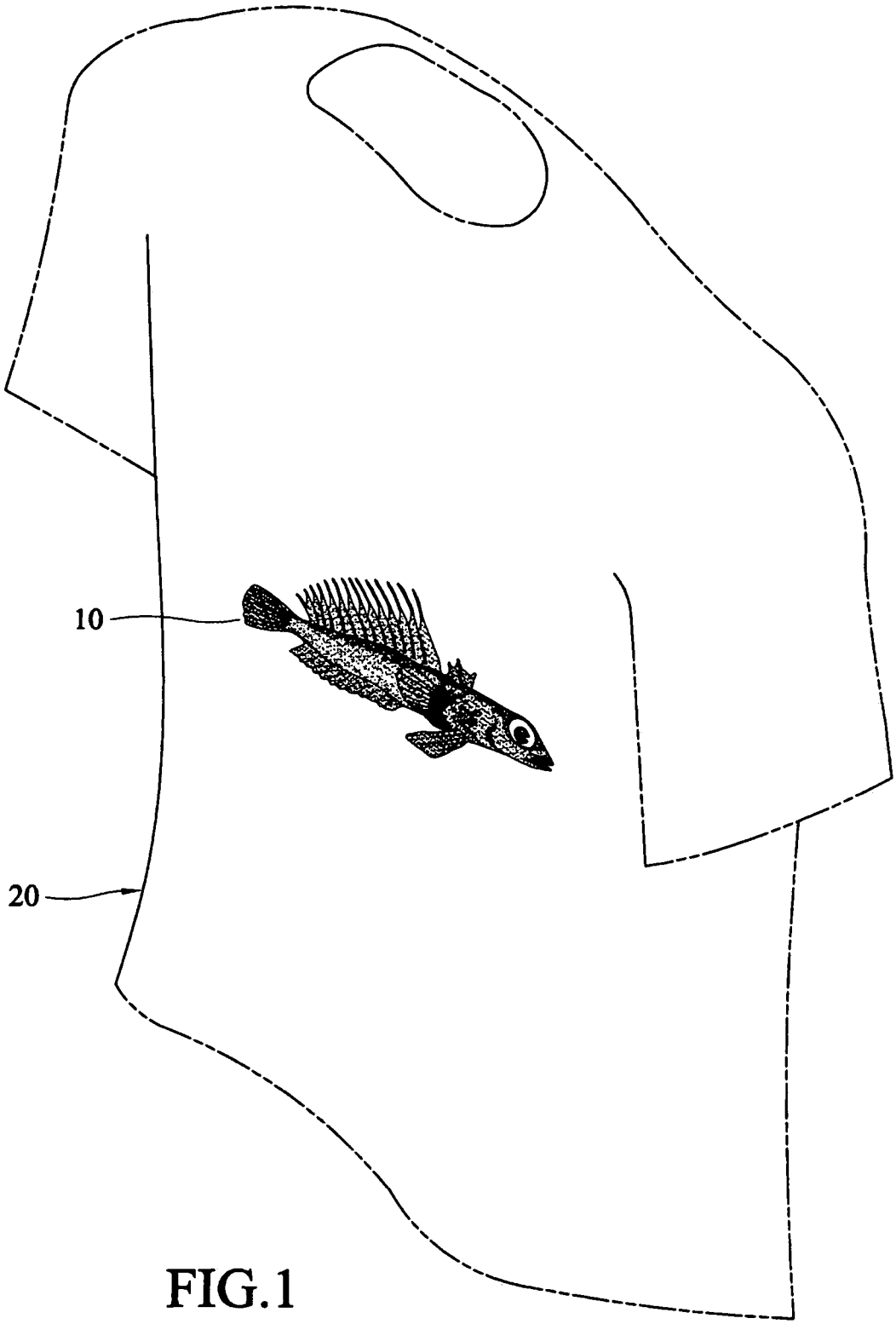
FIG. 1 is a schematic view showing that the pattern of the present invention is applied on clothes.
Figure 2:
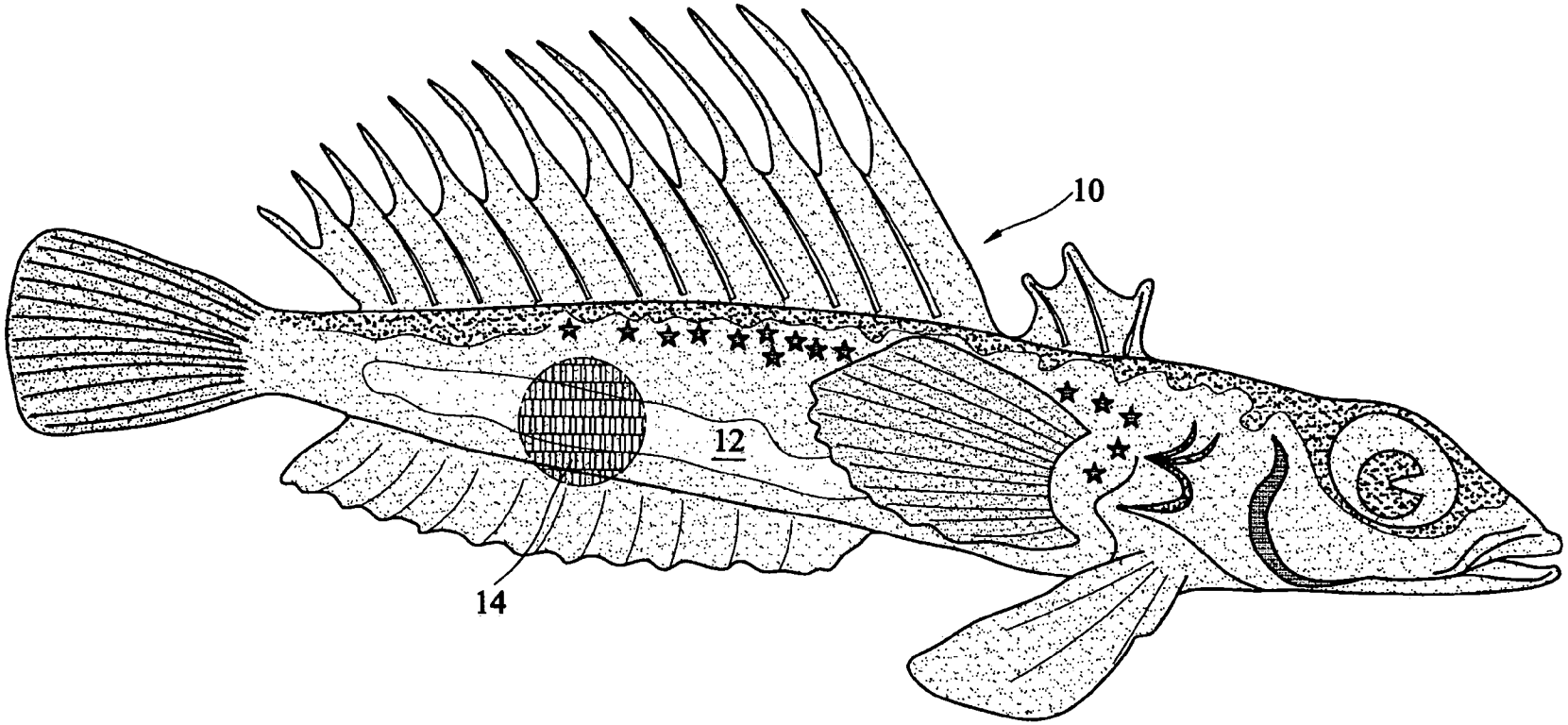
FIG. 2 is a plan view showing the pattern of the present invention.

First, with reference to FIG. 1, it is a schematic view showing that the pattern of the present invention is applied on clothes. Further, FIG. 2 is a plan view showing the pattern of the present invention. As shown in the figures, the pattern 10 can be designed by comprising various decorative stripes, colors and the combination thereof, and is not limited to the specific design shown in the drawings. Further, the pattern 10 can be attached on the clothes 20 by printing, drawing or any suitable processing manners. Further, in addition to the clothes 20, the pattern 10 can be applied to other soft materials on which the pattern can be attached.

Figure 3:
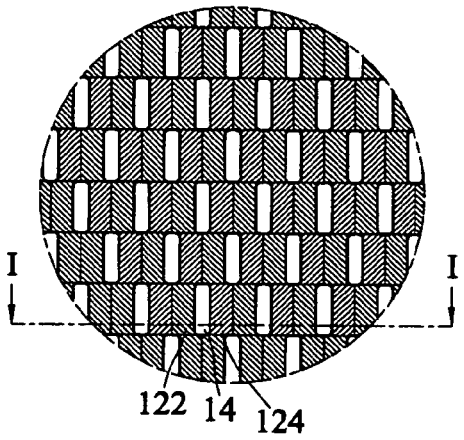
FIG. 3 is an enlarged schematic view showing a partial structure of the pattern in FIG. 2
Figure 4:
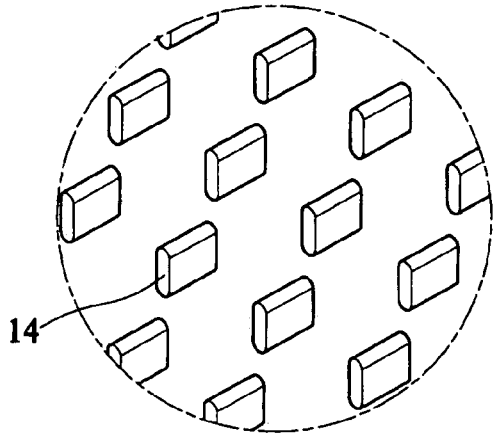
FIG. 4 is a partially perspective view showing the pattern of the present invention.

With reference to FIGS. 3 and 4, the pattern 10 of the present invention includes decorative blocks 12 with arbitrary designs and a plurality of color-shielding pieces 14 embedded on the surface of the decorative blocks 12. At least two opposite outer sides of the color-shielding piece 14 are provided with a colored block 122, 124, respectively. Since the color-shielding piece 14 shields the colored blocks 122, 124, the decorative blocks 12 can generate a visual effect of variable colors when viewed from different angles.

Figure 5:
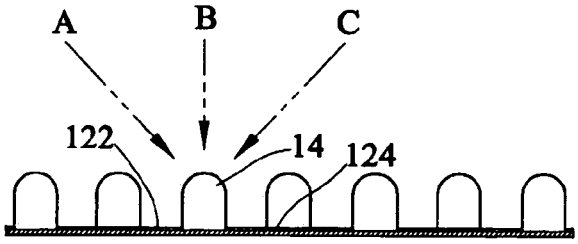
FIG. 5 is a cross-sectional view taken along the line I-I of FIG. 3.

The length and height of the color-shielding piece 14 can be adjusted according to the size of the colored blocks 122, 124. With the provision of the color-shielding piece 14 on the decorative blocks 12, when viewed from the different viewing angles A, B and C in FIG. 5 by a viewer, the pattern 10 represents variable colors due to the fact that the color-shielding piece 14 shields the colored blocks 122, 124.

Figure 6:
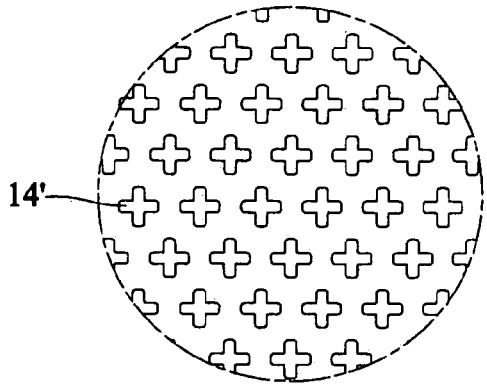
FIG. 6 is a schematic view showing the color-shielding piece of the pattern in accordance with another embodiment of the present invention.
Figure 7:
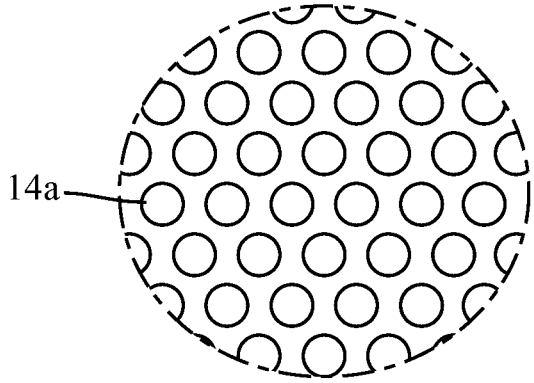
FIG. 7 is a schematic view showing the color-shielding piece of the pattern in accordance with an embodiment of the present invention.
Figure 8:
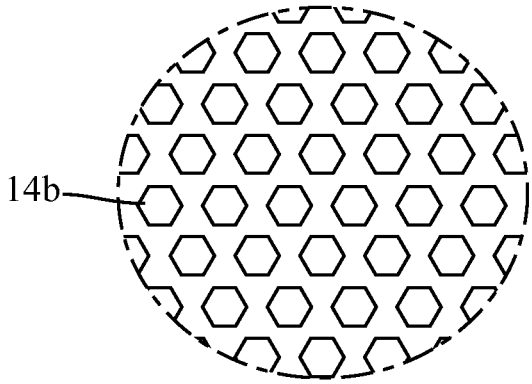
FIG. 8 is a schematic view showing the color-shielding piece of the pattern in accordance with an embodiment of the present invention.

In practice, in addition to the linear shape shown in the drawings, the color-shielding piece 14 can adopt a cross-shaped color shielding piece 14' shown in FIG. 6. Further, other suitable shapes such as circles 14*a*, shown in FIG. 7, or polygons 14*b*, shown in FIG. 8, can be also used as long as they have a function of shielding the colored blocks 122, 124.

Further, the colored blocks 122, 124 provided on both opposite sides of the color-shielding piece 14 have different colors. In practice, the colors of the two colored blocks 122, 124 can be selected from similar colors, contrast colors or other color combinations so as to determine the hue, luminosity and saturation of the colors.

According to the above, the present invention is a pattern 10 combined with color-shielding pieces 14. Due to the fact that the color-shielding pieces 14 shield the colored blocks 122, 124, the decorative blocks 12 can represent a vivid visual effect when viewed from different angles.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A pattern having variable colors, attached on a fabric material and comprising:

at least one decorative block provided on the fabric material, characterized in that a plurality of color-shielding pieces stand on of the at least one decorative block;

wherein a shape of each color-shielding piece is a linear shape;

wherein two colored blocks horizontally lie on two opposite outer sides of the each color-shielding piece and on the at least one decorative block;

wherein two colors of the two colored blocks are different;

wherein the each color-shielding piece is used to shield two colored blocks of the two opposite outer sides thereof such that when viewing the fabric material at different angles or moving the fabric material, the each color-shielding piece shields the two colored blocks of the two opposite outer sides thereof so that the at least one decorative block represents variable colors.

2. A pattern having variable colors, attached on a fabric material and comprising:

at least one decorative block provided on the fabric material, characterized in that a plurality of color-shielding pieces stand on the at least one decorative blocks;

wherein a shape of each color-shielding piece is a circular shape;

wherein at least two colored blocks horizontally lie around an outer side of the each color-shielding piece and on the at least one decorative block;

wherein colors of the at least two colored blocks are different;

wherein the each color-shielding piece is used to shield the at least two colored blocks of the outer side thereof such that when viewing the fabric material at different angles or moving the fabric material, the each color-shielding piece shields the at least two colored blocks of the outer side thereof so that the at least one decorative block represents variable colors.

3. A pattern having variable colors, attached on a fabric material and comprising:

at least one decorative block provided on the fabric material, characterized in that a plurality of color-shielding pieces stand on the at least one decorative blocks;

wherein a shape of each color-shielding piece is selected from cross-like and polygonal shapes;

wherein at least two colored blocks horizontally lie on at least two outer sides of the each color-shielding piece and on the at least one decorative block;

wherein colors of the at least two colored blocks are different;

wherein the each color-shielding piece is used to shield the at least two colored blocks of the at least two outer sides thereof; such that when viewing the fabric material at different angles or moving the fabric material, the each color-shielding piece shields the at least two colored blocks of the at least two outer sides thereof so that the at least one decorative block represents variable colors.

* * * * *